US008231119B2

(12) United States Patent
Marshall et al.

(10) Patent No.: US 8,231,119 B2
(45) **Date of Patent: *Jul. 31, 2012**

(54) WORKBENCH WITH SAW HORSE

(75) Inventors: James D. Marshall, Gananoque (CA); Oleksiy P. Sergyeyenko, Ottawa (CA); David J. Timan, Sydenham (CA); Jamie S. Munn, Maitland (CA)

(73) Assignee: Black & Decker Inc., Nework, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/238,444

(22) Filed: Sep. 21, 2011

(65) Prior Publication Data

US 2012/0006234 A1 Jan. 12, 2012

Related U.S. Application Data

(62) Division of application No. 12/166,474, filed on Jul. 2, 2008, now Pat. No. 8,042,794.

(51) Int. Cl.
*B25B 1/24* (2006.01)

(52) U.S. Cl. ..... 269/266; 269/139; 269/136; 269/16

(58) Field of Classification Search ..... 269/266, 269/139, 136, 138, 16; 108/115–120; 182/154; 297/124, 135, 129, 130, 42, 45, 188.8; 144/286.1, 144/286.5, 287; 248/129, 148
See application file for complete search history.

(56) References Cited

U.S. PATENT DOCUMENTS 495,910 A 4/1893 Reynolds
621,889 A 3/1899 Yunck
1,980,098 A 11/1934 Rutledge
3,342,226 A 9/1967 Marcoux
3,995,716 A 12/1976 Bond
4,014,404 A 3/1977 Jackson
D245,105 S 7/1977 Rader
4,034,684 A 7/1977 Carson et al.
4,061,323 A 12/1977 Beekenkamp
4,066,145 A 1/1978 Pavese
4,068,551 A 1/1978 Kreitz
4,073,484 A 2/1978 Beekenkamp
4,084,803 A 4/1978 Beekenkamp
4,113,056 A 9/1978 DeLorenzo
4,152,834 A 5/1979 Stansberry
4,154,435 A 5/1979 Alessio
4,155,386 A 5/1979 Alessio
4,161,974 A 7/1979 Patterson
4,192,406 A 3/1980 Mitchell
4,236,599 A 12/1980 Luff et al.
4,248,411 A 2/1981 Wagster et al.
4,252,304 A 2/1981 Pettican
4,278,243 A 7/1981 Alessio
4,310,150 A 1/1982 Andrews
4,403,678 A 9/1983 Zieg
4,412,676 A 11/1983 Jackson
4,442,779 A 4/1984 Basten et al.
D274,365 S 6/1984 Lipinski
4,483,524 A 11/1984 Basten et al.
4,527,786 A 7/1985 Hsu
(Continued)

*Primary Examiner* — George Nguyen
(74) *Attorney, Agent, or Firm* — Harness, Dickey & Pierce, P.L.C.

(57) ABSTRACT

A worktable having first and second portions that are removably coupled to one another. When the first and second portions are decoupled from one another they can be arranged into free-standing positions where they can be used as sawhorses.

20 Claims, 10 Drawing Sheets

U.S. PATENT DOCUMENTS 4,570,752 A 2/1986 Chapman et al.
4,620,613 A 11/1986 Albertson
4,711,319 A 12/1987 Sansotta et al.
4,735,245 A 4/1988 Cox
4,763,757 A 8/1988 Cheney
4,770,274 A 9/1988 Middleton
4,771,863 A 9/1988 Stansberry
D306,349 S 2/1990 Logan, Jr.
4,909,491 A 3/1990 Cheng
4,926,966 A 5/1990 Boudreau
4,934,423 A 6/1990 Withrow
4,964,449 A 10/1990 Conners
5,007,502 A 4/1991 Shapiro
D318,127 S 7/1991 Ebeler
D325,639 S 4/1992 Tavella
5,383,977 A 1/1995 Pearce
D362,510 S 9/1995 Jones
5,462,102 A 10/1995 Searfoss
5,467,842 A 11/1995 Meloy
D376,656 S 12/1996 Jackson
5,806,947 A 9/1998 Meisner et al.
D399,681 S 10/1998 Grosfillex
5,829,501 A 11/1998 DeVito
D406,905 S 3/1999 Librach
5,875,828 A 3/1999 Quiram et al.
5,921,301 A 7/1999 Quiram et al.
5,921,347 A 7/1999 Rodriguez et al.
5,954,156 A 9/1999 Cooke
5,988,243 A 11/1999 Ayala et al.
6,029,721 A 2/2000 O'Banion
6,047,750 A 4/2000 Jensen
6,196,534 B1 3/2001 Fortin et al.
6,199,608 B1 3/2001 Ayala et al.
6,415,683 B1 7/2002 Fortin et al.
6,415,831 B2 7/2002 Ayala et al.
6,443,521 B1 9/2002 Nye et al.
6,595,251 B2 7/2003 Ayala et al.
6,640,930 B1 11/2003 Peters et al.
6,658,966 B2 12/2003 Fortin et al.
6,745,804 B2 6/2004 Welsh et al.
6,748,987 B2 6/2004 Ayala et al.
6,755,282 B1 6/2004 Herold
6,848,684 B2 2/2005 Fortin et al.
6,883,793 B2 4/2005 Fortin et al.
7,036,540 B2 5/2006 Welsh et al.
7,048,021 B2 5/2006 Ayala et al.
7,090,210 B2 8/2006 Lawrence et al.
7,185,738 B1 3/2007 Clepper
7,232,120 B2 6/2007 Campbell et al.
7,294,097 B2 11/2007 Parker
7,320,383 B1 1/2008 Plate
7,380,778 B2 6/2008 Lawrence et al.
7,398,737 B1 7/2008 Martellaro
7,418,907 B2 9/2008 Haimoff
7,434,874 B2 10/2008 Jordan
7,445,216 B1 11/2008 Chou
7,604,289 B2 10/2009 Chen
7,610,863 B1 11/2009 Smith-Huebner
7,766,125 B2 8/2010 Fowler
8,042,794 B2 * 10/2011 Marshall et al. ..... 269/266
2002/0083870 A1 7/2002 Chen
2005/0034783 A1 2/2005 Laird

* cited by examiner

WORKBENCH WITH SAW HORSE

CROSS-REFERENCE TO RELATED APPLICATIONS

This application is a division of U.S. Ser. No. 12/166,474 filed Jul. 2, 2008 (now U.S. Pat. No. 8,042,794), the disclosure of which is incorporated by reference as if fully set forth in detail herein.

INTRODUCTION

The present disclosure relates to a workbench and more specifically to a collapsible portable workbench having portions that can be separated from one another to form a pair of saw horses.

Collapsible portable workbenches incorporating a workpiece clamping device provide a convenient structure to secure a workpiece while performing a tooling operation. This type of collapsible, clamping workbench generally includes a pair of top members, one of which is fixed to a supporting structure, while the other is adjustable along the supporting structure toward and away from the first one of the top members by a screw-type handle translation device.

While such collapsible portable workbenches can work extremely well with workpieces of moderate and small sizes, they are often times insufficient when relatively large workpieces, such as a full-sized sheet of plywood or oriented strand board (OSB) or longer lengths of structural lumber.

SUMMARY

In one form, the present teachings provide a workbench that includes a collapsible frame, a plurality of table panes and a second leg set. The collapsible frame has a first leg set that is movable between a first position in which the collapsible frame is in a collapsed condition and a second position in which the collapsible frame is in an expanded position. The plurality of table panels are coupled to the first leg set. The second leg set is coupled to a first one of the plurality of table panels and is positionable in a retracted position and an extended position.

In another form, the present disclosure provides a first leg set, first and second table panels coupled to the first leg set, a lead screw and a second leg set. The lead screw movably couples the first table panel to the first leg set and is rotatable to affect a position of the first table panel relative to the first leg set. The second leg set is coupled to the second table panel. The second table panel can be selectively de-coupled from the first leg set to permit at least portion of the second leg set and the second table panel to form at least one of a saw horse and a work bench.

In a further form, the present teachings provide a worktable that includes first and second frame assemblies, a first table panel and an adjuster. The first frame assembly includes a first frame structure and a first leg set pivotally coupled to the first frame structure. The second frame assembly includes a second frame structure and a second leg set. The second frame structure is selectively coupled to the first frame structure. The second leg set is pivotally coupled to the second frame structure. The adjuster movably mounts the first table panel to the first frame structure and includes a lead screw and a handle for turning the lead screw to thereby affect a position of the first table panel relative to the first frame structure. The first and second leg sets are positionable relative to the first and second frame structure in a collapsed position, in which the first and second leg sets are stored against the first and second frame structures, an extended position, in which the first and second leg sets are configured to cooperate to elevate the first and second frame structures off the ground. When the second frame structure is decoupled from the first frame structure, the first and second leg sets are positionable into an intermediate position in which the first and second frame assemblies are free-standing structures that are configured for use as sawhorses.

In yet another form, the present teachings provide a worktable that includes first and second frame assemblies, a first table panel, and an adjuster. The first frame assembly includes a first frame structure and a first leg set pivotally coupled to the first frame structure. The second frame assembly includes a second frame structure and a second leg set. The second frame structure is selectively coupled to the first frame structure. The second frame structure is slidably movable relative to the first frame structure between a retracted position and an extended position when the second frame structure is coupled to the first frame structure. The second leg set is pivotally coupled to the second frame structure. The adjuster movably mounts the first table panel to the first frame structure and includes a lead screw and a handle for turning the lead screw to affect a position of the first table panel relative to the first frame structure. When the first frame structure is separated from the second frame structure, the first frame structure can be positioned relative to the first leg set to produce a first sawhorse having a generally inverted V-shape and the second frame structure can be positioned relative to the second leg set to produce a second sawhorse having a generally inverted V-shape.

In still another form, the present teachings provide a method for operating a worktable that includes first and second portions that are slidably coupled to one another. The first portion has a first leg set and a first table panel, and the second portion has a second leg set and a second table panel. The method includes: withdrawing one of the first and second portions from the other one of the first and second portions; pivoting the first leg set relative to the first table panel to form a first free-standing sawhorse; and pivoting the second leg set relative to the second table panel to form a second free-standing sawhorse.

Further areas of applicability will become apparent from the description provided herein. It should be understood that the description and specific examples are intended for purposes of illustration only and are not intended to limit the scope of the present disclosure, its application and/or uses in any way.

BRIEF DESCRIPTION OF THE DRAWINGS

The drawings described herein are for illustration purposes only and are not intended to limit the scope of the present disclosure in any way. Similar or identical elements are given consistent identifying numerals throughout the various figures.

DETAILED DESCRIPTION OF THE VARIOUS EMBODIMENTS

Figure 1:
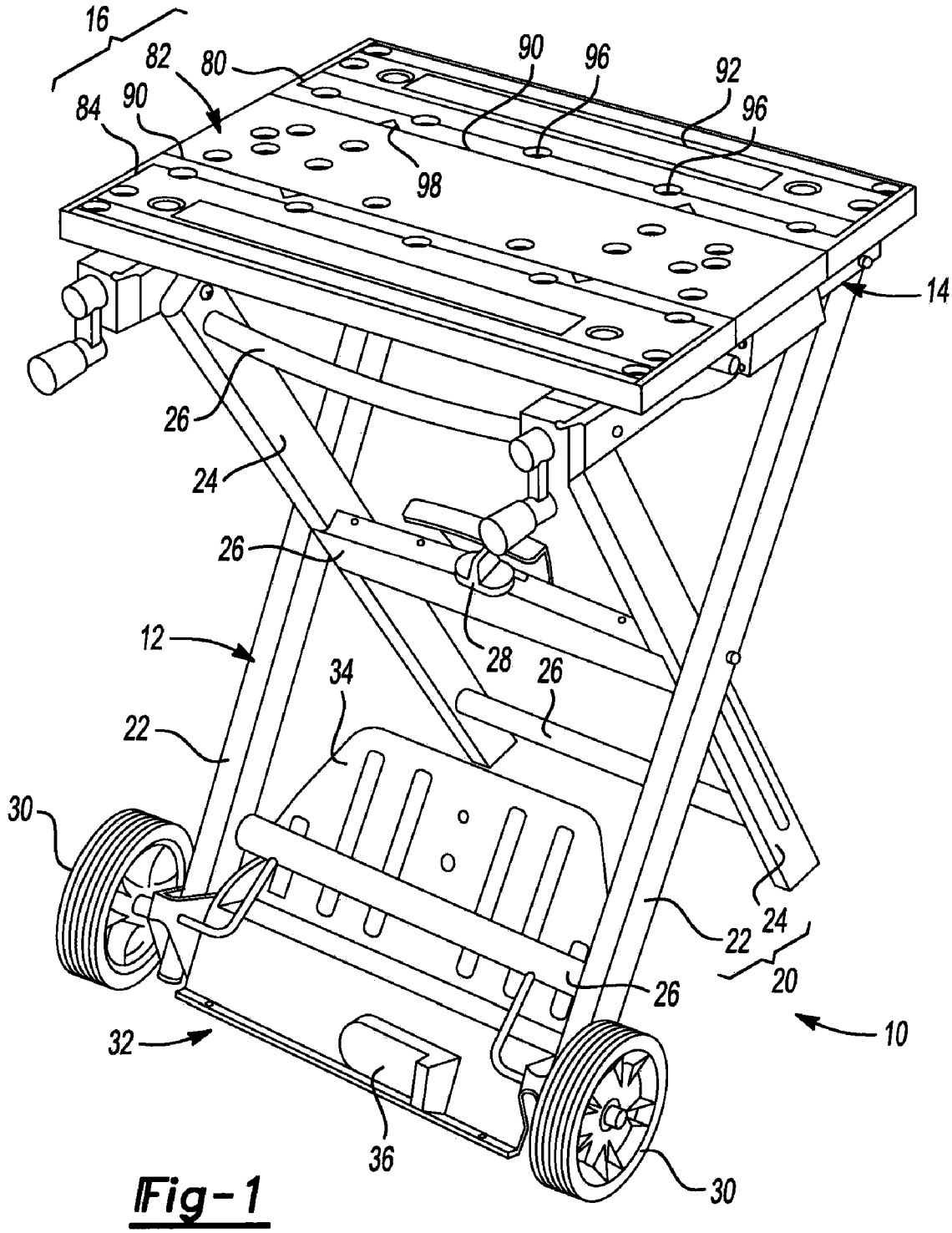
FIG. 1 is a perspective view of a workbench constructed in accordance with the teachings of the present disclosure.
Figure 2:
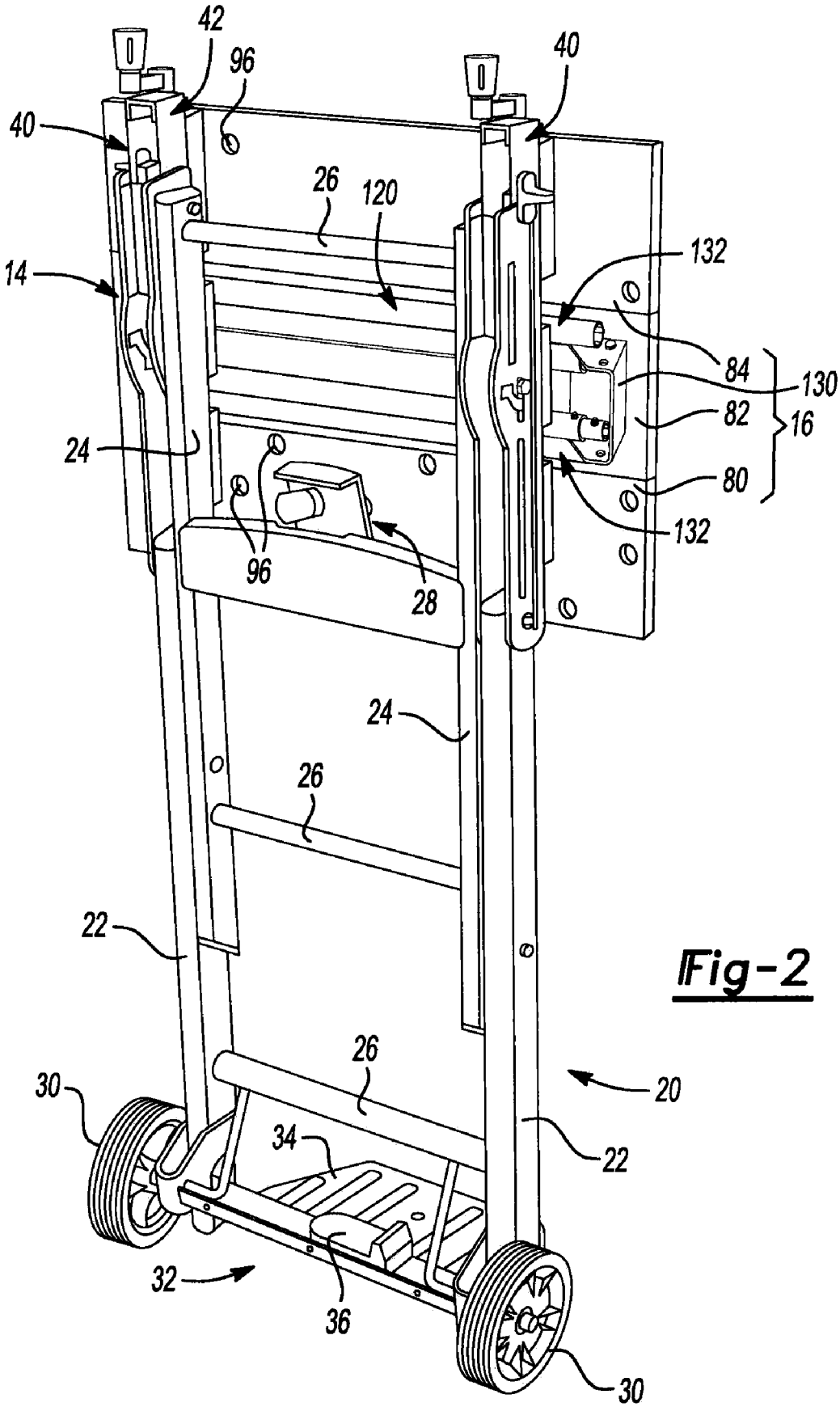
FIG. 2 is a perspective view of the workbench of FIG. 1, illustrating the collapsible frame in a collapsed condition.

With reference to FIGS. 1 and 2 of the drawings, a workbench constructed in accordance with the teachings of the present invention is generally indicated by reference numeral 10. The workbench 10 can include a collapsible frame 12, a support structure 14 and a table top or top structure 16.

The collapsible frame 12 can be formed in any desired manner, such as that which is described in U.S. Pat. Nos. 4,061,323; 4,278,243; 5,383,977; 7,090,210; or 7,232,120, the disclosures of which are hereby incorporated by reference as if fully set forth in detail herein. The collapsible frame 12 can include two laterally spaced-apart first leg sets 20 that are movable between a first position (FIG. 2), in which the collapsible frame is in a collapsed condition, and a second position (FIG. 1) in which the collapsible frame is in an open, expanded or working condition. In the particular example provided, each of the first leg sets 20 includes a first leg 22 and a second leg 24 that are pivotally coupled to the support structure 14 at a first end and pivotally coupled to one another at a location between their opposite ends so that each first leg set 20 is generally X-shaped when the collapsible frame 12 is positioned in the second position.

Also in the example provided, the collapsible frame 12 can include structure for supporting the first leg sets 20, such as various struts or spacers 26 that can be disposed between the first leg sets 20, latches or locks 28 that can be latched or locked to thereby maintain the collapsible frame 12 in the first position and/or second position, wheels 30, which can be coupled to the second end of the first legs 22, and a lift truck structure 32 having a toe plate 34 and a release mechanism 36 that can be employed to lock the toe plate 34 in the raised position (FIG. 1) or a lowered position (FIG. 2). It will be appreciated that locking the toe plate 34 in the lowered position and the first leg set 20 in the first position permits the workbench 10 to be employed as a hand truck as is described in detail in U.S. Pat. No. 7,090,210.

Figure 3:
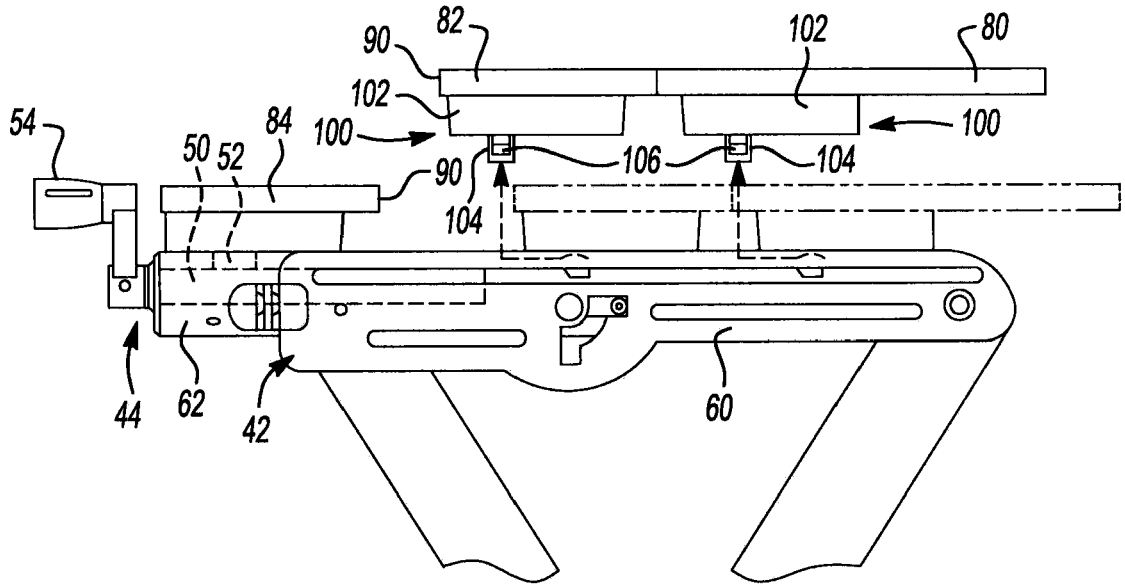
FIG. 3 is a partially exploded side elevation view of a portion of the workbench of FIG. 1, illustrating the support structure and top structure in more detail.
Figure 4:
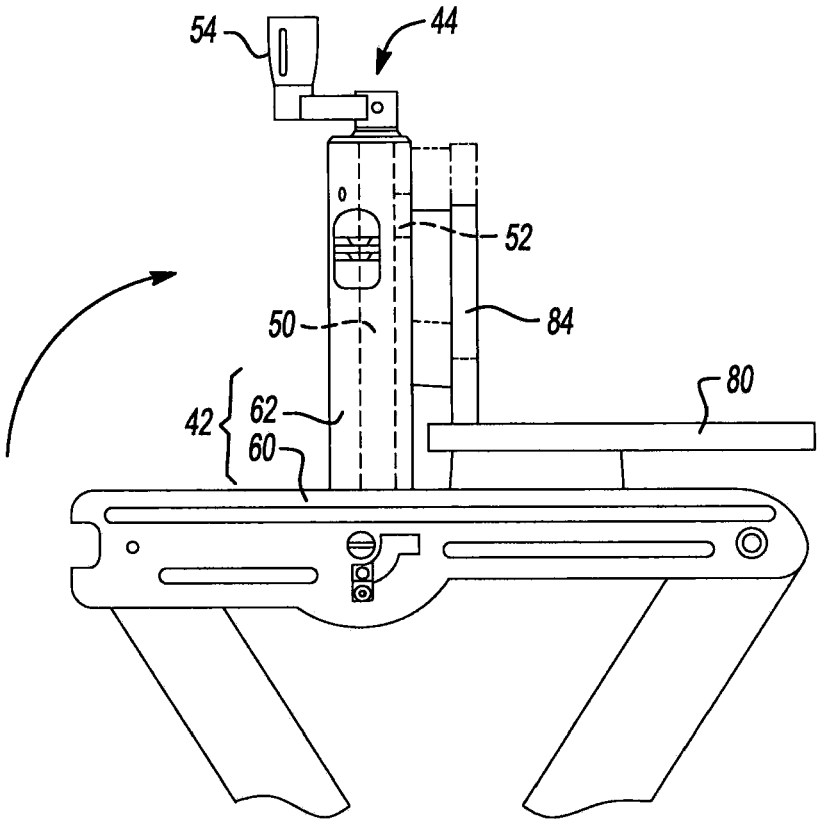
FIG. 4 is a view similar to that of FIG. 3, but illustrating the support structure in a second position in which one of the top members associated with the top structure is positioned in a vertical position.

With reference to FIGS. 2 through 4, the support structure 14 can include a pair of mounts 40. Each of the mounts 40 can include a mount structure 42, which can be pivotally coupled to the opposite lateral sides of the collapsible frame 12 (i.e., to the first end of the first and second legs 22 and 24 in the example provided), and an adjustment mechanism 44 having screw 50, an internally threaded member 52 and a handle 54. The screw 50 can be received in the mount structure 42 and threadably engaged to the internally threaded member 52. The handle 54 can be coupled to an end of the screw 50 such that rotation of the handle 54 causes corresponding rotation of the screw 50.

Each of the mount structures 42 can include a first mount member 60 and a second mount member 62 that can be pivotally coupled to the first mount member 60 and movable between a lowered position, which is shown in FIG. 3, and a raised position that is shown in FIG. 4. Each of the screws 50 is carried by an associated one of the second mount members 62. Further details concerning the first and second mount members 60 and 62, and the construction of the support structure 14 are described in detail in U.S. Pat. No. 7,090,210.

With reference to FIGS. 1 and 2, the top structure 16 can include a plurality of elongated panels or top members 80, 82, and 84 having clamping surfaces 90 and upper surfaces 92 that are disposed in a common plane. The top members 80, 82, and 84 can be formed of a suitable material, such as wood (e.g., plywood) or plastic (e.g., polypropylene) and can include a plurality of bores 96, which can be formed through the top members 80, 82 and 84, a plurality of notches 98 that can be formed in the clamping surfaces. The notches 98 can be aligned to one another and can be configured to facilitate the clamping of a workpiece (not shown), such as a workpiece with a round outer surface, in an orientation that is generally perpendicular to the upper surfaces 92.

Figure 5:
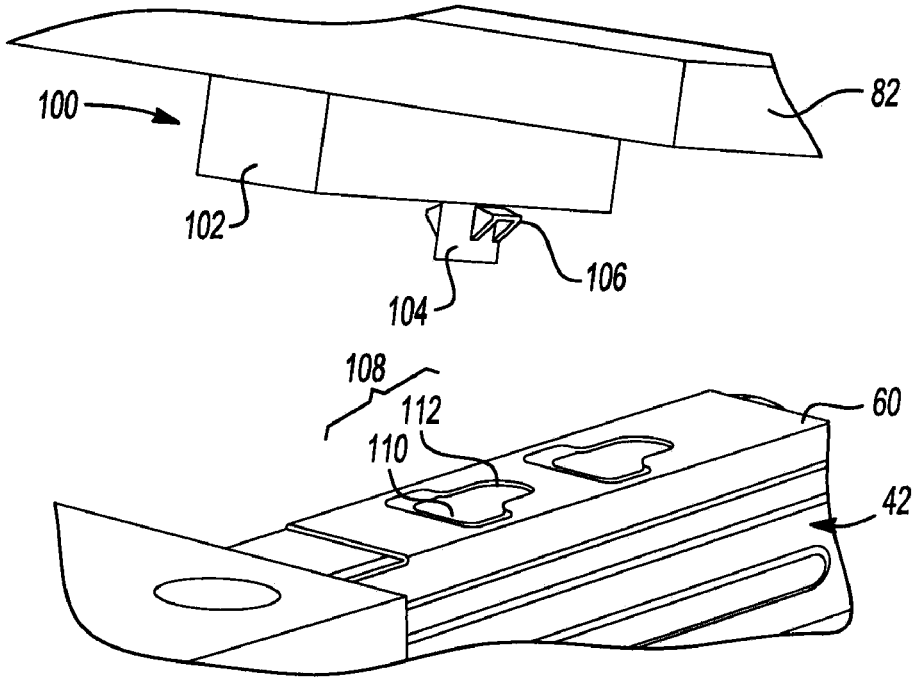
FIG. 5 is an exploded perspective view of a portion of the workbench of FIG. 1, illustrating the connection between a portion of the top structure and the support structure.

With reference to FIGS. 2, 3 and 5, a first one of the top members 80 and a second one of the top members 82 can be coupled to the first mount member 60 in a stationary manner. For example, each of the first and second top members 80 and 82 can include a pair of locking members 100 that permit the first and second top members 80 and 82 to be releasably coupled to the mount structures 42. In the example provided, each of the locking members 100 includes a spacer 102, a post 104 and a pair of wings 106. The spacer 102 can rest on the mount structures 42, while the post 104 and the wings 106 can be received into a corresponding slotted aperture 108 in the mount structures 42. The slotted apertures 108 can have a first portion 110 which can be sized to receive the post 104 and the wings 106 there through, and a second, narrower portion 112 that can be sized such that the wings 106 cannot be pulled through the slotted aperture 108 to disengage the mount structures 42.

A third one of the top members 84 can be mounted on the internally threaded members 52 so that rotation of the handles 54 will cause corresponding translation of the third top member 84 along the screws 50. As the screws 50 are carried by the second mount members 62, the third top member 84 can be locked in a lowered position which is shown in FIG. 3, or a raised position as shown in FIG. 4.

Figure 6:
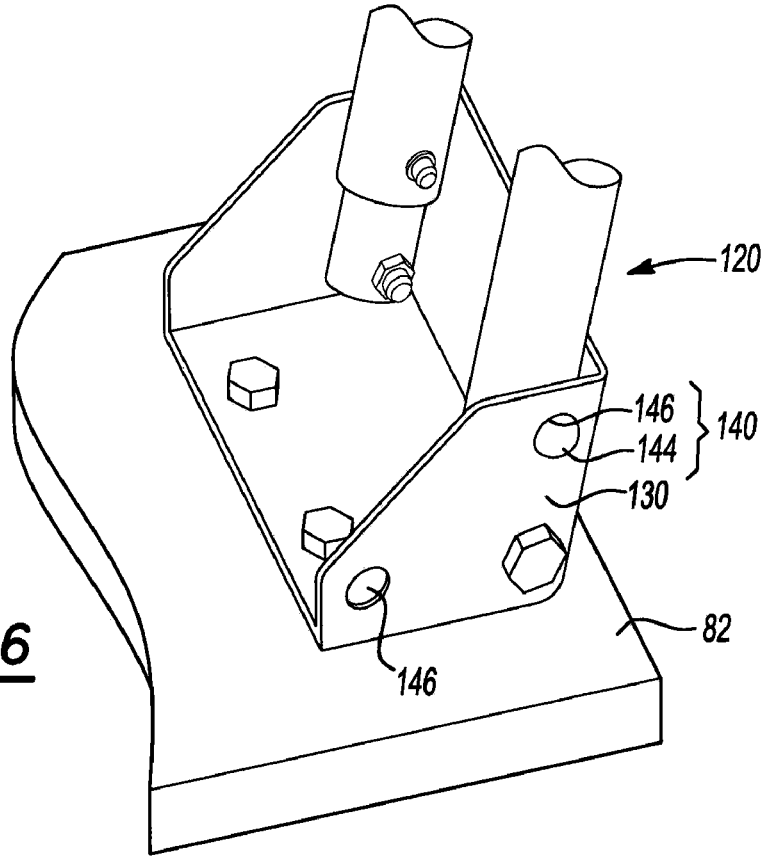
FIGS. 6 through 8 are perspective views of a portion of the workbench of FIG. 1, illustrating the second leg set in more detail.
Figure 7:
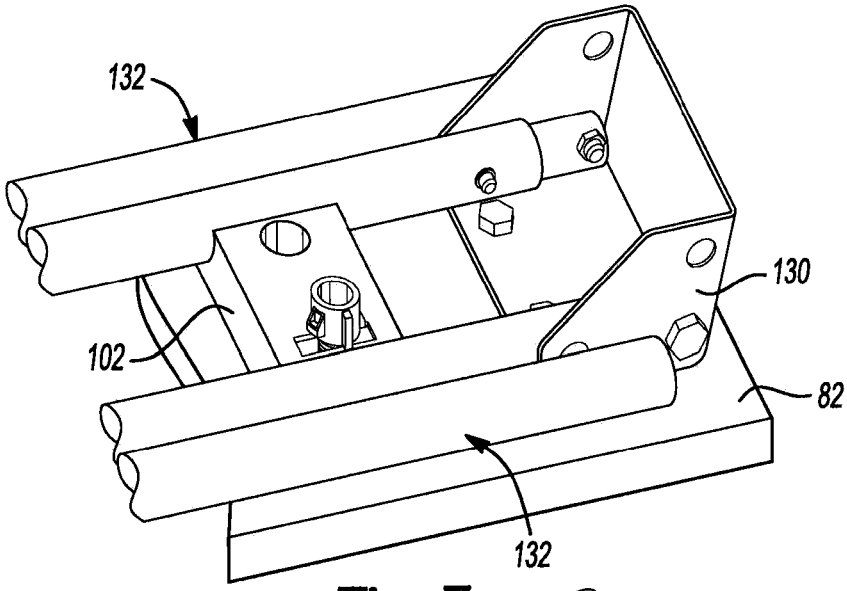

With reference to FIGS. 2, 6 and 7, a second leg set 120 can be coupled to the second top member 82 on a side opposite the upper surface 92 (FIG. 1). The second leg set 120 can include a pair of brackets 130, which can be fixedly coupled to the second top member 82 and laterally spaced apart from one another, and two pair of legs 132. Each pair of legs 132 can be pivotally coupled to an associated one of the brackets 130 and movable between a retracted position, which is shown in FIGS. 2 and 7, and an extended position that is shown in FIG. 6, which permits the second leg set 12 and the second top member 82 to cooperatively form a free standing structure that can be employed as a work bench and/or a saw horse (see, e.g., FIGS. 13 and 14). When positioned in the retracted position, the legs 132 can be disposed relatively closer to the second top member 82 than the distal surface of the spacer 102 so that the legs 132 do not contact the mount structures 42 when the second top member 82 is removably secured to the support structure 14.

Figure 8:
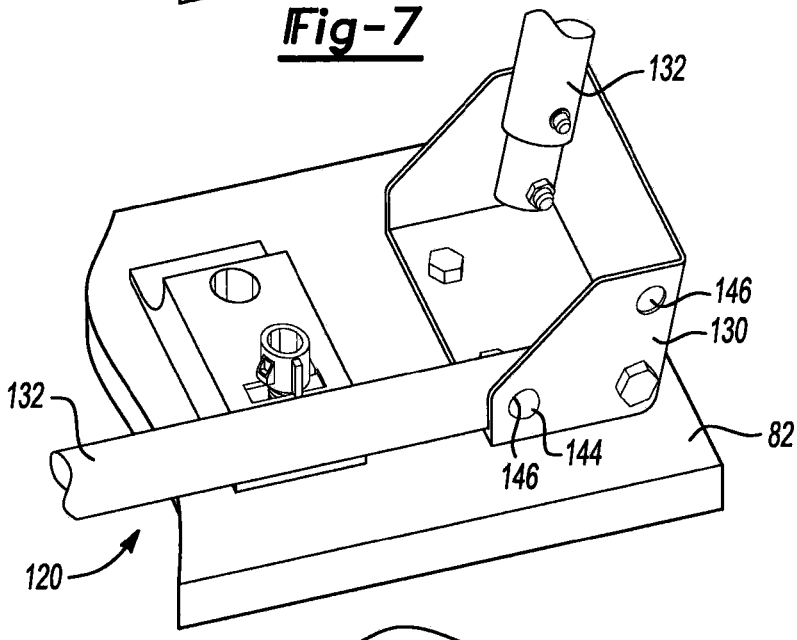

With reference to FIGS. 6 and 8, a leg lock 140 can be employed to maintain one or more of the legs 132 in the extended position and/or retracted position. The leg lock 140 can include a detent mechanism with a detent pin 144 that is configured to engage one or more detent holes 146. In the particular example provided, the detent holes 146 are formed in the brackets 130 and the detent pins 144, which are carried by each of the legs 132, are spring biased to engage the detent holes 146 when the legs 132 are positioned in the extended or retracted positions.

Figure 9:
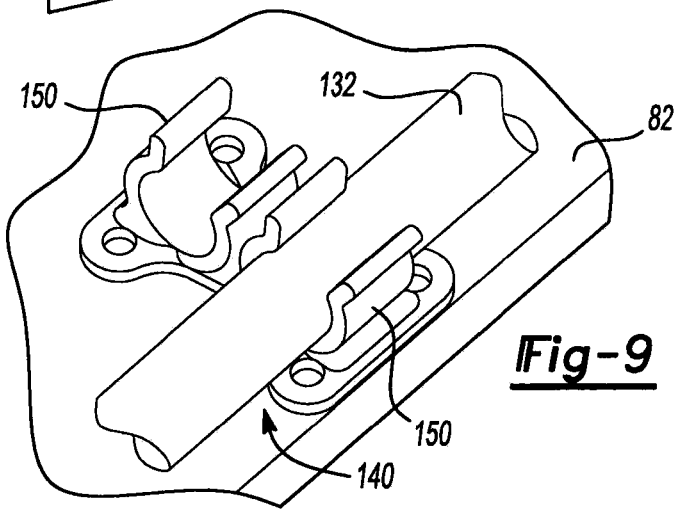
FIGS. 9 and 10 are perspective views illustrating an alternately constructed leg locks for maintaining the second leg set in a retracted position.
Figure 10:
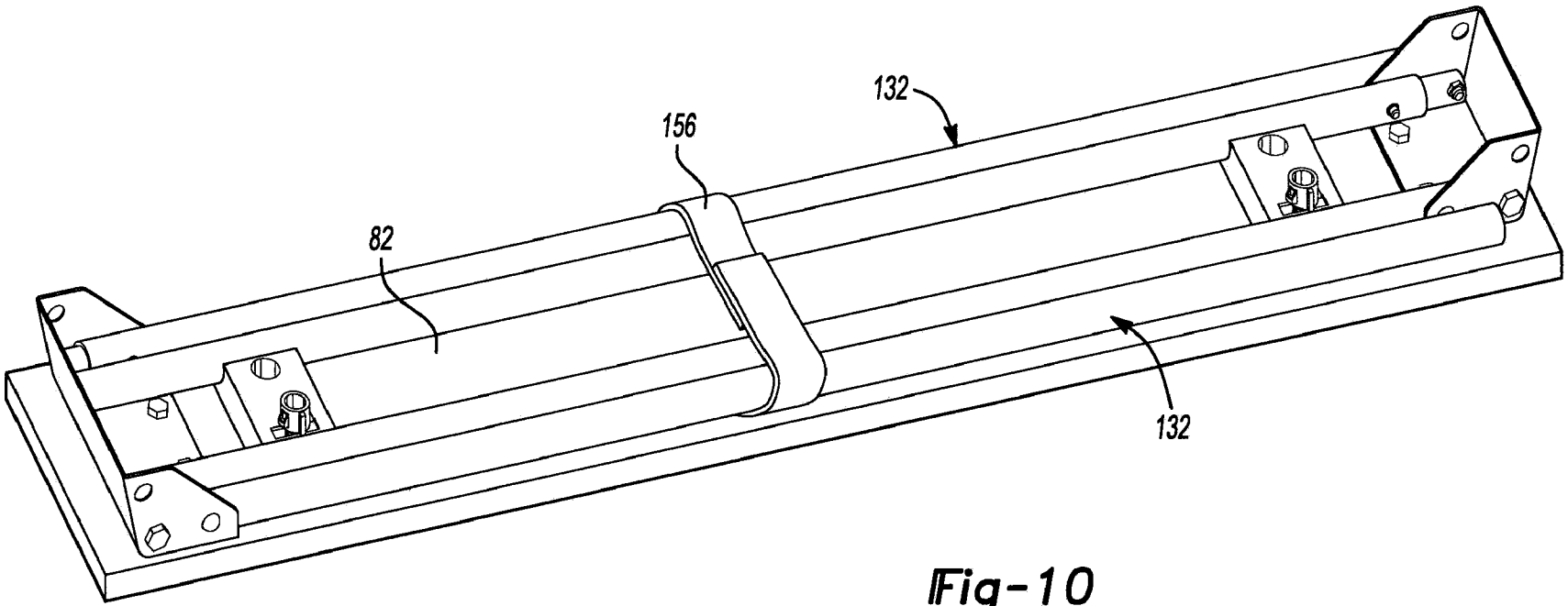

It will be appreciated that the leg lock 140 could employ other means to retain the legs 132 in the extended or retracted positions. For example, a plurality of latches 150 could be coupled to the second top member 82 as shown in FIG. 9. The latches 150 can be configured to grip or latch onto a portion of the legs 132 when the legs 132 are positioned in the retracted position. Another example is illustrated in FIG. 10 in which a strap 156, which can be coupled to the second top member 82, is employed to secure the legs 132 to one another and/or to the second top member 82. In the particular example provided, a VELCRO® fastener is employed to retain the ends of the strap 156 to one another, but it will be appreciated that any type of fastener could be employed.

Figure 11:
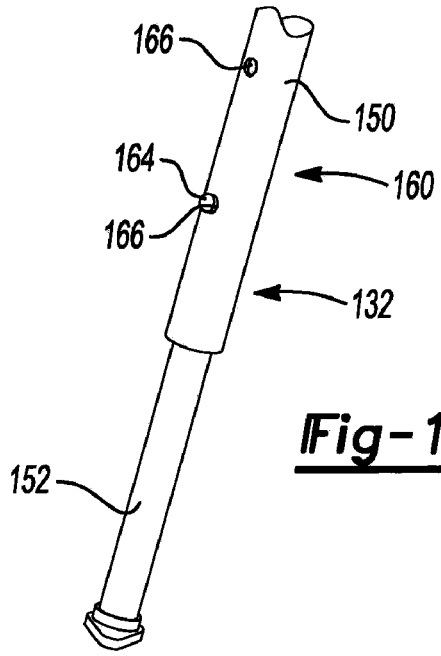
FIG. 11 is a perspective view of a portion of a leg of the second leg set.
Figure 12:
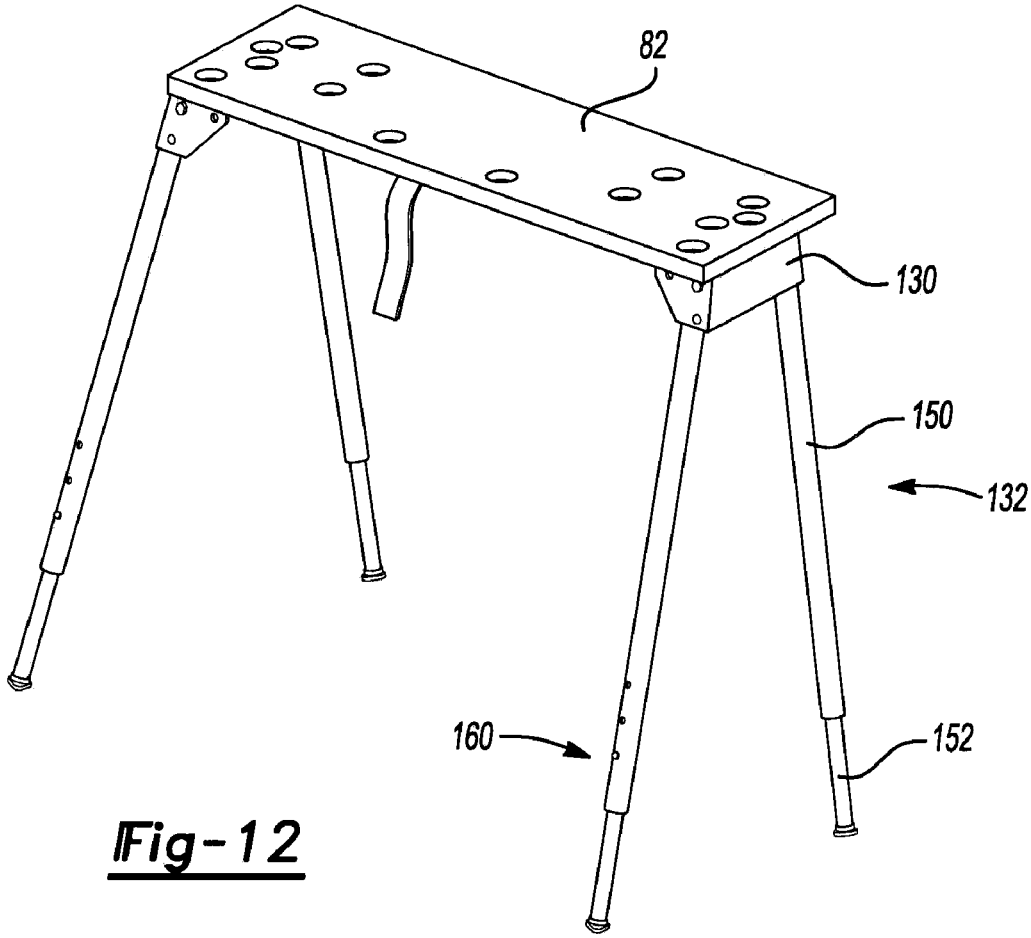
FIG. 12 is a perspective view of a portion of the workbench of FIG. 1, illustrating the second leg sets in the extended position and cooperating with the second top member to form a saw horse.
Figure 13:
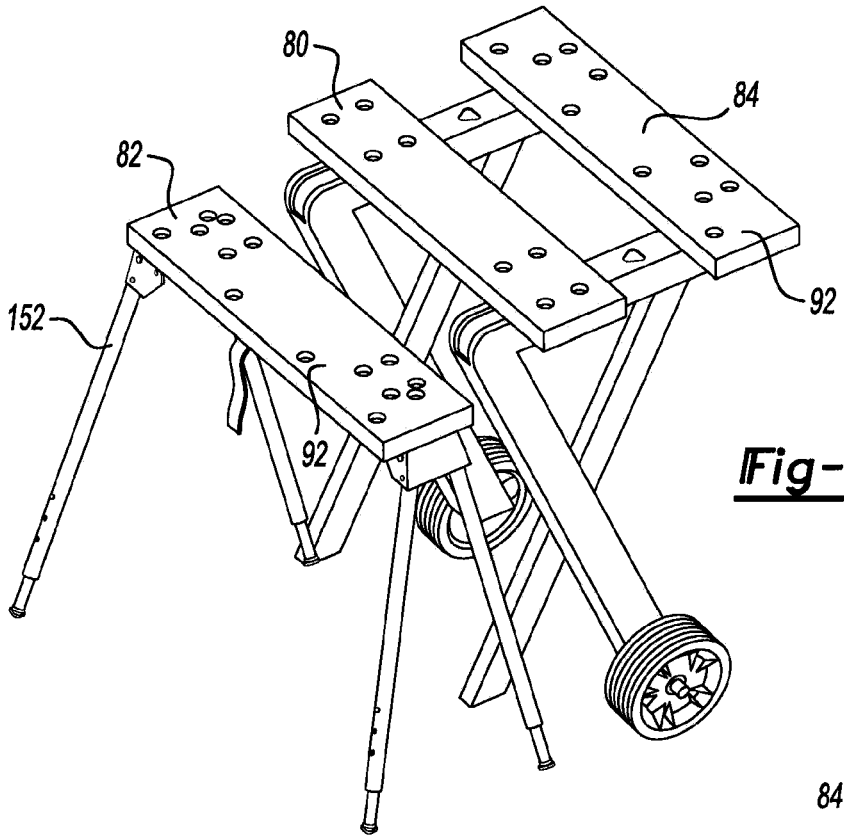
FIGS. 13 and 14 illustrate the positioning of the legs of the second leg sets at different heights relative to the remainder of the workbench.
Figure 14:
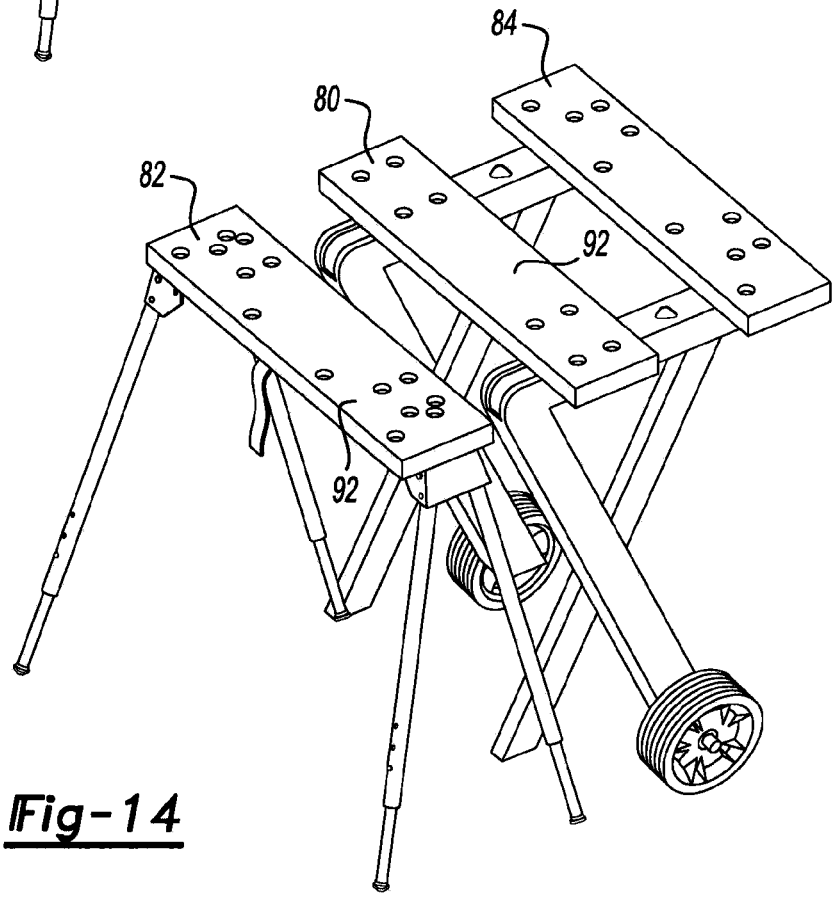

With reference to FIGS. 11 and 12, each of the legs 132 can include a first portion 150, which can be pivotally coupled to an associated one of the brackets 130, and a second portion 152 that can be telescopically engaged with the first portion 150. The second portion 152 of the legs 132 can be moved between a first position (shown in FIG. 2), in which the overall length of the legs 132 is shortest, and a second position (shown in FIG. 12) in which the overall length of the legs 132 is greatest. The legs 132 can include a telescoping lock 160 that permits the second portion 152 to be locked relative to the first portion 150. The telescoping lock 160 could include a spring biased detent pin 164 that can be selectively engaged to a corresponding detent hole 166 to thereby inhibit relative movement between the first and second portions 150 and 152 at a desired location. It will be appreciated that several detent holes 166 can be employed to permit the first and second portions 150 and 152 to be selectively locked at one of several predetermined locations so that the upper surface 92 of the second top member 82 can be correspondingly positioned at several different working heights as shown in FIGS. 13 and 14.

Figure 15:
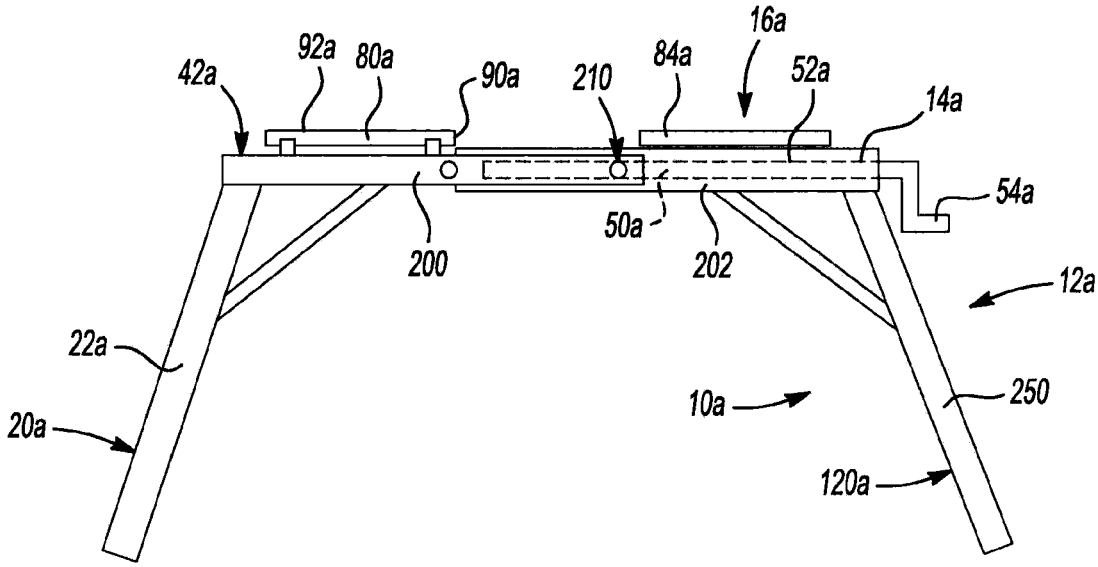
FIG. 15 is a schematic elevation view of a second embodiment of a workbench constructed in accordance with the teachings of the present disclosure.

A second embodiment of a workbench constructed in accordance with the teachings of the present disclosure is illustrated in FIG. 15 and generally indicated by reference numeral 10*a*. The workbench 10*a* can include a collapsible frame 12*a*, a support structure 14*a* and a table top or top structure 16*a*.

With additional reference to FIGS. 15 through 18, the collapsible frame 12*a* can include a first frame member 200, a second frame member 202, a first leg set 20*a* and a second leg set 120*a*. The first and second frame members 200 and 202 can be releasably coupled to one another in a desired manner. In the example provided, the first frame member 200 is telescopically received into the second frame member 202 so as to be selectively engaged (FIG. 15) and disengaged (FIG. 18) thereto. While engaged to one another, the first and second frame members 200 and 202 may be moved relative to one another to adjust their length. A suitable locking mechanism 210 can be employed to inhibit relative movement between the first and second frame members 200 and 202 when they are engaged to one another. For example, one or more detent pins 212 can be carried by the second frame member 202 and can be selectively engaged to corresponding detent holes 214 formed in the first frame member 200.

Figure 16:
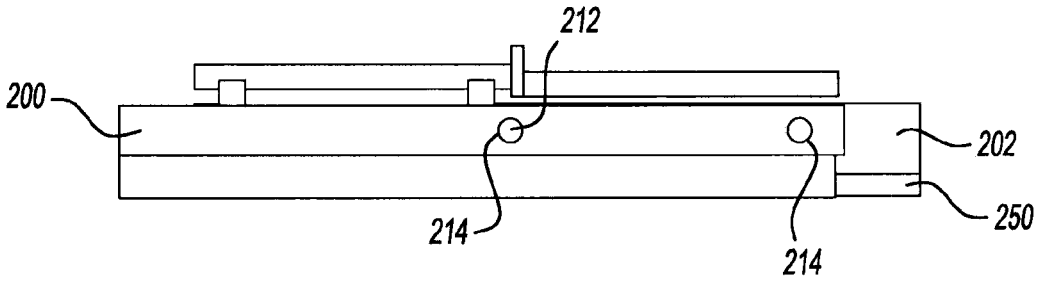
FIGS. 16 and 17 are schematic elevation views of the workbench of FIG. 15, but illustrating the frame members in a telescopically shortened position and a telescopically extended position, respectively.
Figure 17:
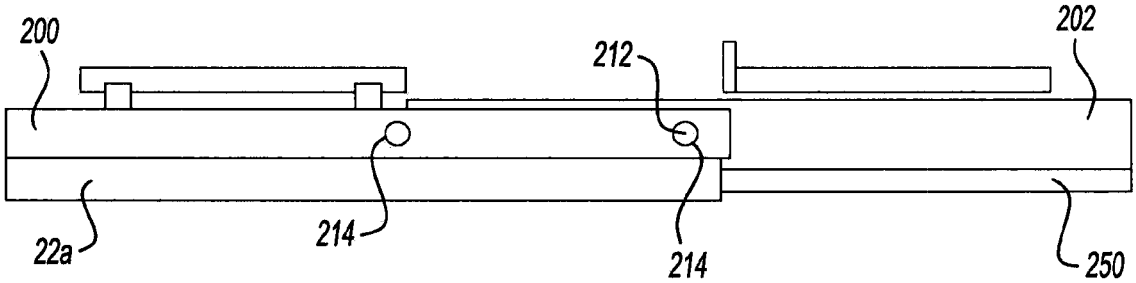
Figure 19:
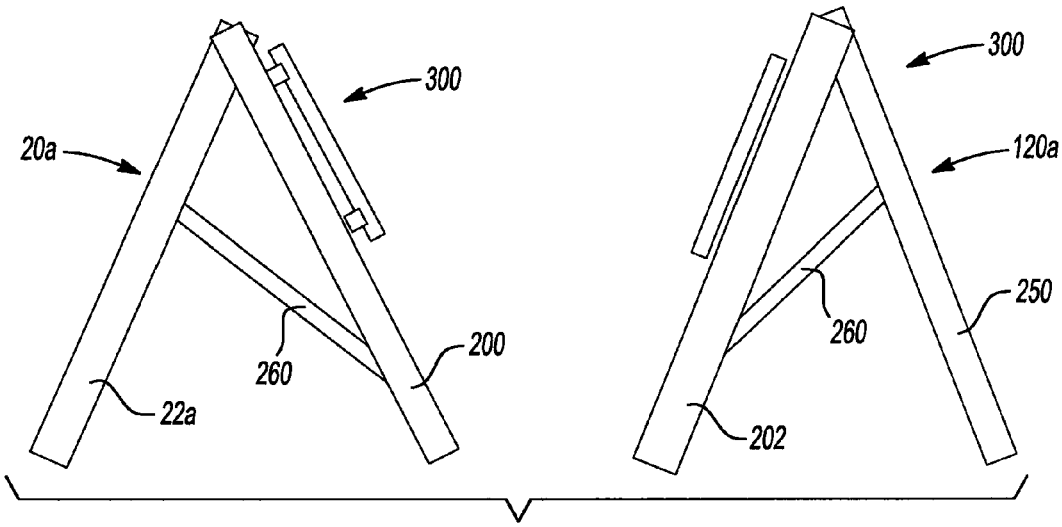
FIG. 19 is a side elevation view illustrating the workbench as forming two saw horses.

The first leg set 20*a* can include a pair of first legs 22*a* that can be pivotally coupled to the first frame member 200 and the second leg set 120*a* can include a pair of second legs 250 that can be pivotally coupled to the second frame member 202. The first and second leg sets 20*a* and 120*a* can be moved between an extended position, which is shown in FIG. 15, a retracted position, which is shown in FIGS. 16 and 17, and an intermediate position that is shown in FIG. 19. When positioned in the retracted position, the first and second leg sets 20*a* and 120*a* are spaced laterally apart so that they will not contact one another when the first and second frame members 200 and 202 are moved between the telescopically shortened position and the telescopically lengthened position.

Similar to the previously described embodiment, the collapsible frame 12*a* can include structure for supporting the first and second leg sets 20*a* and 120*a*, such as various struts 260 and spacers (not shown) that can be disposed between the legs 22*a* and 250 of the first and second leg sets 20*a* and 120*a*, respectively, as well as latches or locks (not specifically shown) that can be latched or locked to thereby maintain the collapsible frame 12*a* in a opened or working condition and/or a collapsed condition.

The support structure 14 can include a pair of mount structures 42*a*, which can be integrally formed with the first and second frame members 200 and 202, and an adjustment mechanism 44*a* having a pair of screws 50*a*, a pair of internally threaded members 52*a* and a pair of handles 54*a*. Each of the screws 50*a* can be received in a corresponding one of the mount structures 42*a* and threadably engaged to one of the internally threaded members 52*a*. Each handle 54*a* can be coupled to an end of one of the screws 50*a* such that rotation of the handle 54 causes corresponding rotation of the screw 50*a*.

The top structure 16*a* can include a plurality of elongated panels or top members 80*a* and 84*a* having clamping surfaces 90*a* and upper surfaces 92*a* that are disposed in a common plane. A first one of the top members 80*a* can be removably coupled to the mount structure 42*a*. For example, the first top member 80*a* can be constructed with a pair of locking members (not specifically shown) that are similar to the locking members 100 described in the previous embodiment illustrated in FIG. 5. A second one of the top members 84*a* can be mounted on the internally threaded members 52*a* so that rotation of the handles 54*a* will cause corresponding translation of the second top member 84*a* along the screws 50*a*.

Figure 18:
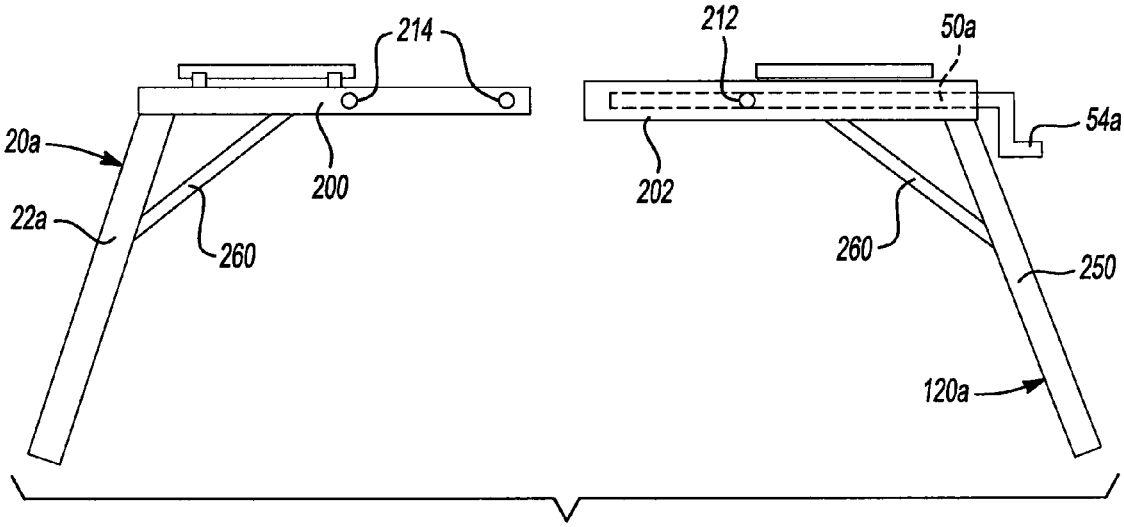
FIG. 18 is a view similar to that of FIG. 15, but illustrating the frame members of the collapsible frame separated from one another.

With reference to FIGS. 18 and 19, the first and second frame members 200 and 202 can be separated from one another and the first and second leg sets 20*a* and 120*a* can be folded (into the intermediate position) relative to the first and second frame members 200 and 202, respectively, to form a pair of saw horses 300. The handles 54*a* may be removed from the screws 50*a* as necessary.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A worktable comprising:

a first frame assembly comprising a first frame structure and a first leg set pivotally coupled to the first frame structure;

a second frame assembly comprising a second frame structure and a second leg set, the second frame structure being selectively coupled to the first frame structure, wherein the second frame structure is slidably movable relative to the first frame structure between a retracted position and an extended position when the second frame structure is coupled to the first frame structure, the second leg set being pivotally coupled to the second frame structure;

a first table panel; and an adjuster that movably mounts the first table panel to the first frame structure, the adjuster comprising a lead screw and a handle for turning the lead screw to thereby affect a position of the first table panel relative to the first frame structure;

wherein when the first frame structure is separated from the second frame structure, the first frame structure can be positioned relative to the first leg set to produce a first sawhorse having a generally inverted V-shape and the second frame structure can be positioned relative to the second leg set to produce a second sawhorse having a generally inverted V-shape.

2. The worktable of claim 1, further comprising a second table panel coupled to the second frame structure.

3. The worktable of claim 2, wherein the second table panel is removably coupled to the first table panel.

4. The worktable of claim 1, further comprising a latch for selectively securing the second frame structure to the first frame structure in the retracted and extended positions.

5. The worktable of claim 4, wherein the latch comprises a detent pin mounted to one of the first and second frame structures and a pair of detent holes formed in the other one of the first and second frame structures, and wherein engagement of the detent pin with one of the detent holes maintains the second frame structure in an associated one of the retracted and extended positions.

6. The worktable of claim 1, wherein the second frame structure is slidably movable relative to the first frame structure along a table slide axis and wherein the lead screw is oriented generally parallel to the table slide axis.

7. The worktable of claim 1, wherein the handle is disposed on an end of the first frame structure opposite an end to which the second frame structure is slidably received.

8. A worktable comprising:

a first frame assembly comprising a first frame structure and a first leg set pivotally coupled to the first frame structure;

a second frame assembly comprising a second frame structure and a second leg set, the second frame structure being selectively coupled to the first frame structure, the second leg set being pivotally coupled to the second frame structure;

a first table panel; and an adjuster that movably mounts the first table panel to the first frame structure, the adjuster comprising a lead screw and a handle for turning the lead screw to thereby affect a position of the first table panel relative to the first frame structure;

wherein the first and second leg sets are positionable relative to the first and second frame structure in a collapsed position, in which the first and second leg sets are stored against the first and second frame structures, an extended position, in which the first and second leg sets are configured to cooperate to elevate the first and second frame structures off the ground, and wherein when the second frame structure is decoupled from the first frame structure, the first and second leg sets are positionable into an intermediate position in which the first and second frame assemblies are free-standing structures that are configured for use as sawhorses.

9. The worktable of claim 8, further comprising a second table panel coupled to the second frame structure.

10. The worktable of claim 9, wherein the second table panel is removably coupled to the first table panel.

11. The worktable of claim 8, further comprising a latch for selectively securing the second frame structure to the first frame structure.

12. The worktable of claim 11, wherein the latch comprises a detent pin mounted to one of the first and second frame structures and a detent hole formed in the other one of the first and second frame structures, and wherein engagement of the detent pin with the detent hole releasably secures the first and second frame structures to one another.

13. The worktable of claim 8, wherein the second frame structure is slidably movable relative to the first frame structure along a table slide axis and wherein the lead screw is oriented generally parallel to the table slide axis.

14. The worktable of claim 9, wherein the handle is disposed on an end of the first frame structure opposite an end to which the second frame structure is slidably received.

15. A method for operating a worktable, the worktable having first and second portions that are slidably coupled to one another, the first portion having a first leg set and a first table panel, the second portion having a second leg set and a second table panel, the method comprising:

withdrawing one of the first and second portions from the other one of the first and second portions;

pivoting the first leg set relative to the first table panel to form a first free-standing sawhorse; and pivoting the second leg set relative to the second table panel to form a second free-standing sawhorse.

16. The method of claim 15, wherein each of the first and second free-standing sawhorses has a generally inverted V-shape in side elevation.

17. The method of claim 15, wherein prior to withdrawing the one of the first and second portions from the other one of the first and second portions the method further comprises:

sliding the one of the first and second portions relative to the other one of the first and second portions from a retracted position to an extended position.

18. The method of claim 15, further comprising:

inserting the one of the first and second portions to the other one of the first and second portions; and latching the first and second portions to one another.

19. The method of claim 15, wherein prior to withdrawing the one of the first and second portions from the other one of the first and second portions the method further comprises:

rotating a lead screw to translate one of the first and second table panels relative to the other one of the first and second table panels.

20. The method of claim 19, wherein prior to withdrawing the one of the first and second portions from the other one of the first and second portions the method further comprises: removing a handle from the lead screw.

* * * * *